US005633645A

United States Patent [19]

Day

[11] Patent Number: 5,633,645

[45] Date of Patent: May 27, 1997

[54] PATCH ANTENNA ASSEMBLY

[75] Inventor: Stephen R. Day, Wigan, England

[73] Assignee: Pilkington plc, United Kingdom

[21] Appl. No.: 520,396

[22] Filed: Aug. 29, 1995

[30] Foreign Application Priority Data

Aug. 30, 1994 [GB] United Kingdom ..... 9417401

[51] Int. Cl.[6] ..... H01Q 1/38

[52] U.S. Cl. ..... 343/700 MS; 343/829; 343/713

[58] Field of Search ..... 343/700 MS, 829, 343/846, 713, 848, 830; H01Q 1/38

[56] References Cited

U.S. PATENT DOCUMENTS

| | | | |
|---|---|---|---|
| 4,364,050 | 12/1982 | Lopez | 343/700 MS |
| 4,761,654 | 8/1988 | Zaghloul | 343/700 MS |
| 4,843,400 | 6/1989 | Tsao et al. | 343/700 MS |
| 4,903,033 | 2/1990 | Tsao et al. | 343/700 MS |
| 4,963,891 | 10/1990 | Aoyagi et al. | 343/700 MS |
| 5,043,738 | 8/1991 | Shapiro et al. | 343/700 MS |
| 5,241,321 | 8/1993 | Tsao | 343/700 MS |
| 5,448,250 | 9/1995 | Day | 343/700 MS |

FOREIGN PATENT DOCUMENTS

| | | |
|---|---|---|
| 0590928 | 4/1994 | European Pat. Off. . |
| 2685130 | 6/1993 | France . |
| 3834075 | 4/1989 | Germany . |
| 0217703 | 10/1985 | Japan . |
| 020105704 | 2/1990 | Japan . |
| 03254208 | 3/1991 | Japan . |
| 2251520 | 8/1992 | United Kingdom . |

OTHER PUBLICATIONS

M. Edimo, A. Sharaiha and C. Terret, "Optimised Feeding of Dual Polarised Broadband Aperture–Coupled Printed Antenna", Electronics Letters, vol. 28, No. 19, 1785–1787, Sep. 10, 1992.

Article: A. Adrian and D.H. Schaubert, "*Dual Aperture–Coupled Microstrip Antenna For Dual Or Circular Polarisation*", Electronics Newsletter, vol. 23, No. 23, 1226–7, Nov. 5, 1987.

H. Iwasaki and K. Kawabata, "*A Circularly Polarized Microstrip Antenna With a Cross Slot*", The 3rd Asia–Pacific Microwave Conference Proceedings, Tokyo, 1990, pp. 281–284.

*Primary Examiner*—Hoanganh T. Le

*Attorney, Agent, or Firm*—Burns, Doane, Swecker & Mathis, L.L.P.

[57] ABSTRACT

A laminar patch antenna comprises a ground plane element with a cross shaped aperture sandwiched between two dielectric layers with a patch radiator on one dielectric layer and a transmission line circuit on the other dielectric layer. The transmission line circuit has linear conductors overlying respective sectors between slots of the aperture, the conductors providing a feedline and stub projection with lines of similar type overlying opposite sectors of the cross and conductors of different type overlying adjacent sectors of the cross.

17 Claims, 6 Drawing Sheets

PATCH ANTENNA ASSEMBLY

The invention relates to a patch antenna assembly and particularly to such an assembly suitable for use on a vehicle glazing panel.

BACKGROUND OF THE INVENTION

Aperture coupled patch antennae are known for use in receiving and transmitting high frequency signals such as microwave signals. These are particularly suitable for mobile satellite communications and are applicable to communication systems in mobile vehicles. An example of such a patch antenna is shown in U.S. Pat. No. 5,043,738. Our EP Application 93307667.1 also shows an aperture coupled patch antenna for use with a mobile vehicle. In that case the automotive glass is shown as the dielectric between the patch and the ground plane. Problems can arise with environmental protection when the patch is provided on an exterior surface of a vehicle glazing panel. Furthermore problems may arise in achieving satisfactory dielectric properties between the patch and the ground plane depending on the thickness of glass used. Furthermore, if the antenna dielectric is laminated glass and the plastics interlayer is included between the patch and the ground plane then further losses may arise. It is also desirable that the antenna should be capable of transmitting high quality circular polarised radiation thereby giving improved operation in a global positioning system where the vehicle may be required to travel in any direction. In the above mentioned EP Application 93307667.1, two feed lines for the antenna are arranged to be insulated at their cross-over point in order to achieve high quality circular polarisation.

It is an object of the present invention to provide an improved antenna wherein some embodiments have an improved feed system for achieving high quality circular polarised radiation.

It is a further object of the invention to provide some embodiments in which the dielectric properties between the patch and the ground plane can be carefully controlled to provide high quality performance without such dependence on the glass used in the vehicle glazing panel.

It is a further object of the invention to provide some embodiments in which the patch may be protected by location on an internal surface of a vehicle glazing panel.

It is a further object of the invention to provide some embodiments in which the antenna is formed as an assembly which may be attached to an internal surface of a vehicle glazing panel after formation of the glazing panel.

SUMMARY OF THE INVENTION

The invention provides a laminar patch antenna comprising a ground plane element having opposing first and second faces, a first dielectric planar member adjacent a first face of the ground plane element, a patch radiator on a face of the first dielectric member remote from the ground plane element, a second dielectric planar member adjacent the second face of the ground plane element, and a transmission line circuit for feeding the antenna, which circuit is located on a face of the second dielectric member remote from the ground plane element, said ground plane element having a cross-shaped aperture formed by two intersecting slots to couple the transmission line circuit to the patch radiator, and said transmission line circuit comprising at least three linear conductors joined end to end at a junction overlying a centre of said cross-shaped aperture with each of said linear conductors overlying a respective sector between slots of said cross-shaped aperture, each of said linear conductors being either of a first type forming a feed line or of a second type forming a stub projection providing an electrical impedance between said junction and the ground plane in a sector underlying the stub projection, wherein any conductors overlying opposite sectors are of the same type and any conductors overlying adjacent sectors are of a different type.

In one embodiment two feed lines are provided end to end overlying opposite sectors of the ground plane.

A single stub projection may be provided overlying a sector of the ground plane between said opposite sectors of the ground plane.

Alternatively two stub projections are provided overlying respective sectors of the ground plane between said opposite sectors of the ground plane.

In a further embodiment a single feed line with two stub projections are provided.

Preferably the linear conductors are arranged orthogonally relative to each other.

Each stub may have a projection length of one-quarter wavelength of the antenna wavelength.

Preferably the cross-shaped aperture comprises two linear slots arranged at right angles to each other and the conductors are symmetrically arranged relative to the cross-shaped aperture so that each arm of the tranmission line circuit lies midway between a pair of slots.

Said patch is secured to a glass sheet forming part of a vehicle glazing panel.

Preferably said second dielectric member comprises a printed circuit board.

Preferably said first dielectric member comprises a porous compressible layer.

Preferably said first dielectric member comprises a layer of porous plastics foam.

The invention also provides a laminar patch antenna comprising a ground plane element having opposing first and second faces, a first dielectric planar member adjacent a first face of the ground plane element, a patch radiator on a face of the first dielectric member remote from the ground plane element, a second dielectric planar member adjacent the second face of the ground plane element, and a transmission line circuit for feeding the antenna, which circuit is located on a face of the second dielectric member remote from the ground plane element, said ground plane element having a cross-shaped aperture formed by two intersecting slots to couple the transmission line circuit to the patch radiator, and said transmission line circuit comprising at least two linear conductors overlying said cross-shaped aperture with a junction between the conductors overlying the centre of the cross-shaped aperture, said first dielectric planar member comprising a porous compressible layer.

Said stub may have an outwardly flared shape with flared edges aligned with adjacent slots of the cross-shaped aperture.

The invention includes a laminated patch antenna assembly for attachment to an inner surface of a vehicle glazing panel such as a windshield or window, which assembly comprises a laminar patch antenna as aforesaid together with means for securing said compressible layer face to face against said inner surface, the compressibility of the layer permitting the layer to conform with, and lie face to face with, said inner surface when not flat.

DESCRIPTION OF THE PREFERRED EMBODIMENTS

To understand the capabilities of the antennae of the present invention the properties of a general four port device consisting of a patch ground plane with cross aperture 14, and four feed lines coming to the antenna centre each feed in one quadrant of the space defined by the cross aperture will be explained.

Figure 1:
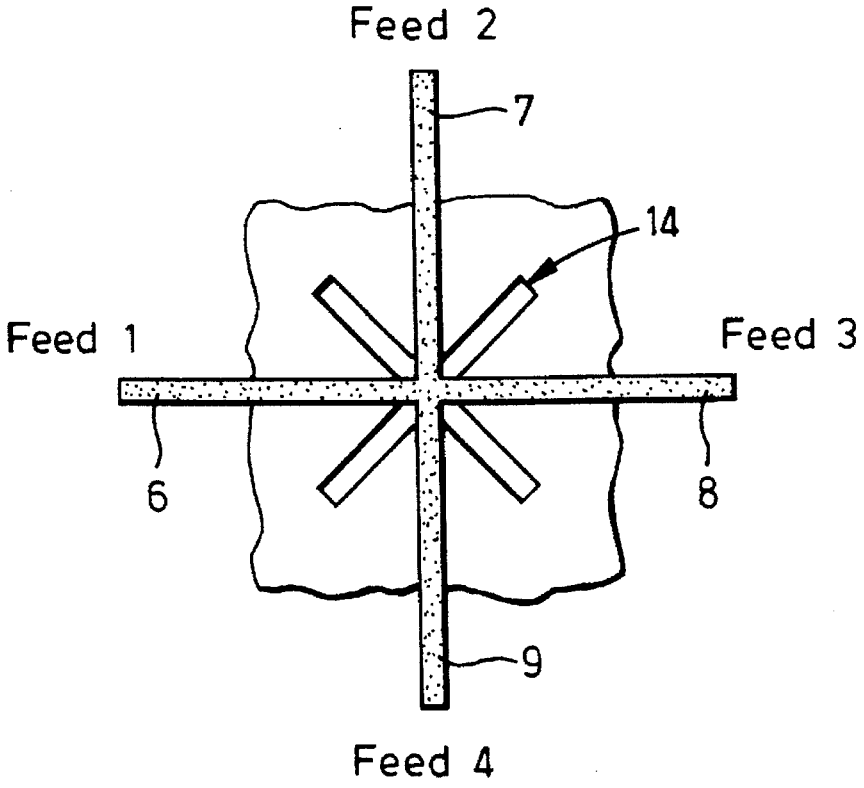
Fig. 1 (Prior Art)
FIG. 1 is an explanatory diagram of a patch antenna.
Figure 2:
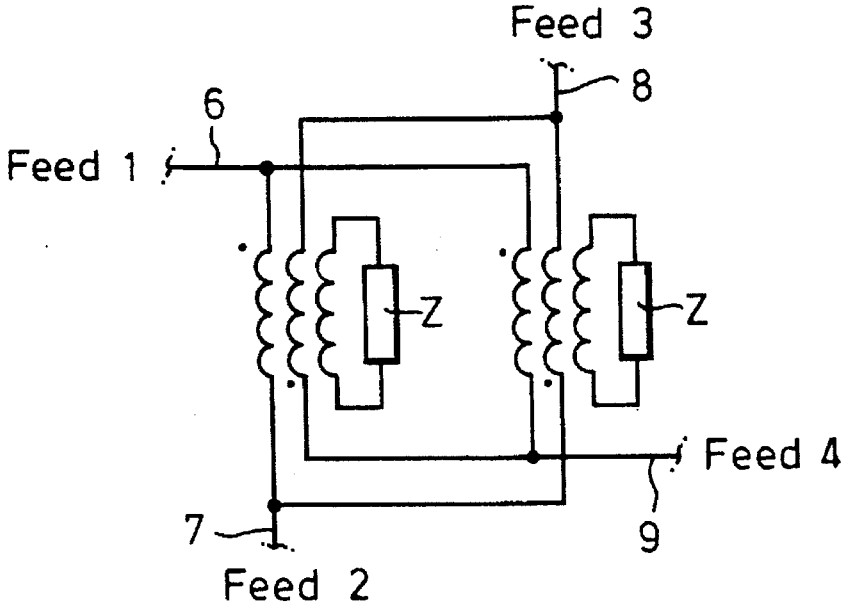
Fig. 2 (Prior Art)
FIG. 2 shows the equivalent circuit of FIG. 1.

The antenna will use a resonant patch with two orthogonal axis of symmetry such as a circle or square placed centrally above the cross aperture which again will have two orthogonal axes of symmetry. FIG. 1 shows four feeds 6, 7, 8, 9, over the cross aperture and an equivalent circuit for the network is shown in FIG. 2. The two impedances Z shown are the antenna radiation impedances of two linear orthogonal polarisation modes. These linear modes are arranged in the same directions as the "arms" of the cross aperture.

This equivalent circuit has no node where the four feeds meet. The ground plane is not all at the same potential and currents induced in the ground plane cannot flow directly from under feed 1 to under feed 3 without going via the positions of feed 2 or 4. Currents in the ground plane flowing from for example under feed 1 to under feed 2 cause an induced potential in the ground plane between positions under feeds 3 and 4.

It has been found that using this equivalent circuit two particularly useful antenna feeds can be provided. These have two feeds from opposite quadrants, the other two potential feed positions being occupied by impedance elements. These are the dual linearly polarised antenna and the dual circularly polarised antenna. In the dual linear feed case the two impedances required are short and open circuits, in the dual circular feed case the required impedances are jZ and −jZ. Practically, it is convenient in the circular feed case to ensure that Z is largely a real resistive impedance so that jZ and −jZ are largely inductive and capacitive impedances.

The benefit of aperture coupling is that no connections are required through materials. The impedances can therefore be formed using straight or flared open circuit transmission lines, commonly called stubs. Alternatively they could be formed using resistive capacitive and inductive components in series or parallel configuration with stubs, or ohmic contacts running through the feed track substrate onto the ground plane.

Where the feed and stub tracks are arranged to have transmission line impedances equal to Z and the stubs are not of a flared type, for the linear polarisation case the stub lengths are ideally $n\lambda/2$ and $\lambda/4+m\lambda/2$ and for the circular case the stub lengths are ideally $\lambda/8+n\lambda/2$ and $3\lambda/8+m\lambda/2$, where $\lambda$ is the wavelength in the transmission line and m and n are positive integers. For the linear feed case one stub length of zero can be used. In practice line end effects, perturbations due to the proximity of the stubs to non-infinite ground plane especially close to the aperture may make minor tuning of the stub line lengths necessary.

The circular feed method has the potential problem that the jZ and −jZ stubs can be seen in series from the point of view of currents under the patch. The series sum has a zero impedance and affects the patch-aperture interactions. It has been found possible to use stubs differing from the perfect jZ and −jZ by a small amount to reduce these unwanted patch-aperture interactions while preserving acceptable levels of polarisation circularity, feed isolation and polarisation orthogonality. The circular feed method therefore has advantages in terms of feed circuit area when circular polarisations are required from patch antenna.

Patch antenna embodiments with Z approximately real and 50 Ohms will be used to illustrate the feed technique. The antenna may use a low density plastic or rubber foam material as the antenna dielectric between the patch and ground plane. This material is chosen for its low microwave losses and ability to conform to the shape between a glass antenna superstrate which may be slightly curved and a planar circuit board carrying the feed components. The patch and aperture are centrally aligned, both having two orthogonal axis of symmetry.

Figure 3:
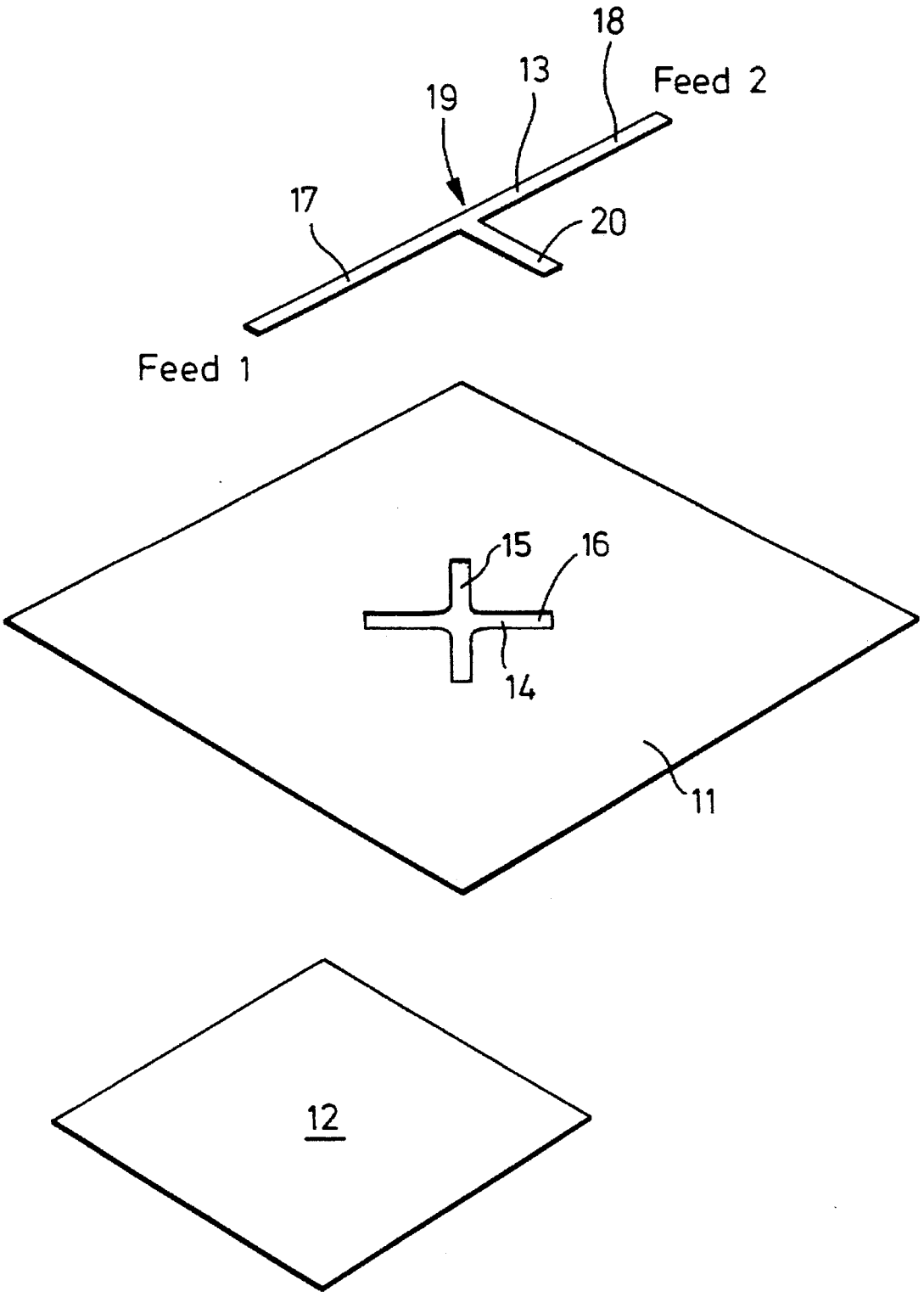
FIG. 3 is an exploded view of three conducting layers in a laminar patch antenna in accordance with the invention.
Figure 4:
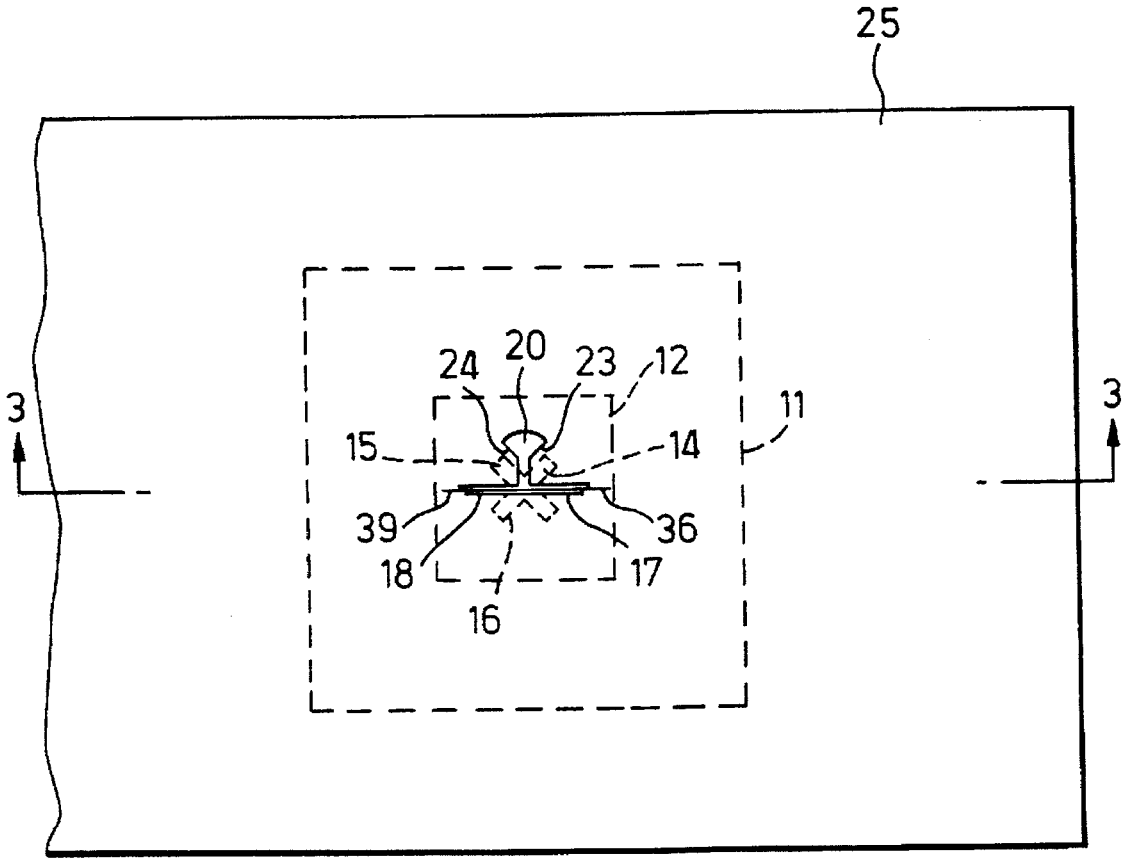
FIG. 4 is a plan view of a laminar patch antenna mounted on a vehicle glazing panel in accordance with the present invention.

The laminar patch antenna of FIG. 3 has three conducting layers. A conducting ground plane layer 11 has a lower face directed towards a radiating patch 12 and in use a suitable dielectric layer is interposed between the ground plane 11 and the patch 12. A transmission line feed circuit forms a further conducting layer spaced from an upper surface of the ground plane element 11 and in use is separated from the ground plane element by a second dielectric layer. The ground plane element 11 has a central cross-shaped aperture 14 consisting of two linear slots 15 and 16 arranged to intersect at right angles and to provide coupling between the feed circuit 13 and the patch 12. In this case the feed circuit 13 comprises a first linear conductor 17 arranged end to end and in alignment with a second linear conductor 18 which form a junction 19. A single stub projection 20 extends from the junction 19 at right angles to the line of the linear conductors 17 and 18. Although the stub projection 20 is formed as a short linear conductor in FIG. 3, it may be outwardly flared on moving away from the linear conductors 17 and 18 as shown in the embodiment of FIG. 4. In use in a laminated assembly, the junction 19 is arranged to lie centrally over the centre of the cross 14 with the linear conductors 17 and 18 being symmetrically arranged relative to the cross-shaped aperture 14 with each of the linear conductors 17 and 18 overlying the midpoints of opposite sectors formed between the slots 15 and 16 of the cross 14. The stub projection 20 lies midway over a further sector of the cross located between the opposing sectors covered by the linear conductors 17 and 18. In the case of the outwardly flared stub 20 the flared edges 23 and 24 are arranged to lie parallel to the adjacent edges of the slots 15 and 16.

Figure 5:
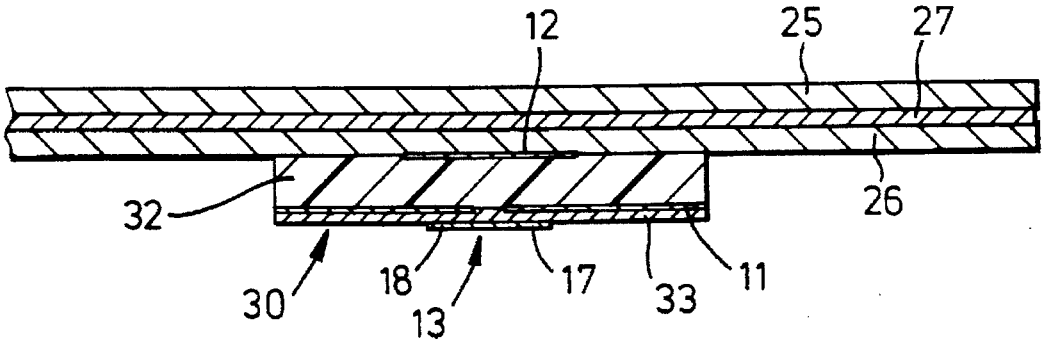
FIG. 5 is a section on the line 3—3 in FIG. 2.

FIGS. 4 and 5 show a laminar patch antenna similar to that of FIG. 3 when mounted on a vehicle glazing panel. The glazing panel comprises a laminated windshield having glass layers 25 and 26 separated by a plastics interlayer 27.

Glass panel 26 forms an inner surface of the vehicle windscreen and secured against this inner face is a laminar patch antenna assembly 30. Similar reference numerals to those used in FIG. 1 are marked on similar parts. The patch 12 lies closely against the inner face of glass sheet 26 and is separated from the ground plane 11 by a layer of porous plastics foam 32 forming a first dielectric planar member. The foam 32 is filled with airholes and forms a particularly effective dielectric layer as air has a low dielectric loss. The foam layer 32 can be made as thick as desired in order to give required operational characteristics. Furthermore the foam is compressible and deformable so that the assembly can be attached to a curved glass sheet 26 with deformation of the foam layer accommodating the deviation from planar structure. The ground plane 11 is secured to the foam layer 32 remote from the patch 12. The transmission feedlines 17 and 18 are formed on a printed circuit board layer 33 forming a second dielectric layer. The board 33 is secured against the ground plane element 11. As is shown in FIGS. 4 and 5, the feed circuit 13 is centrally and symmetrically located over the cross-shaped aperture 14 formed in the ground plane 11 as previously described with reference to FIG. 3. In this example the patch element 12 may be formed as a conducting layer on the surface of the inner glass sheet 26. Alternatively the patch 12 may be formed as part of an after market assembly of the type shown in FIG. 2 to be described below. In that case the patch 12 forms part of a unit with the foam 22, ground plane 11 and printed circuit board 33 which can be secured by suitable adhesive or other means to the glass panel 26 after the vehicle glazing panel is made.

Figure 6:
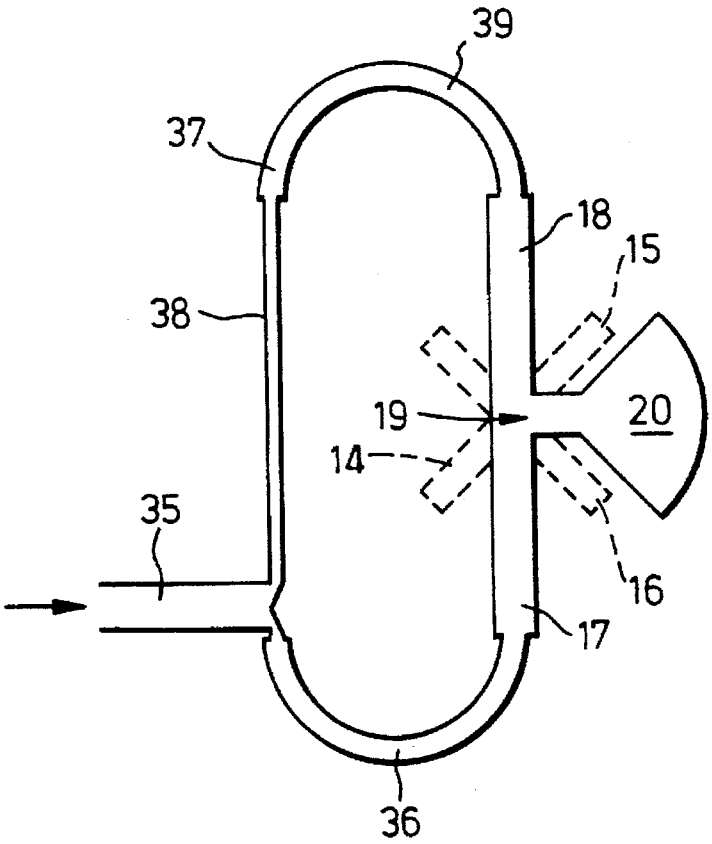
FIG. 6 shows the connection feed circuit of FIG. 2.

The feed system 13 is shown in more detail in FIG. 6.

Each of the linear conductors 17 and 18 is a single 50 Ohm feedline. A 50 Ohm supply feedline 35 is split to two 100 Ohms paths. Connector 36 leads from line 35 to an end of conductor 17 remote from the junction 19. Its impedance matches 100 Ohms close to line 35 and 50 Ohms close to line 17. The other connector 37 consists of a thin section 38 and a thicker section 39. Section 39 has the same width as section 36 and is connected to an end of linear conductor 18 remote from the junction 19. It performs a similar function as connector 36. The thinner section 38 is arranged to produce a quarter wavelength delay line in the feed to conductor 18 relative to that of conductor 17. In this way the two transmission lines 17 and 18 are supplied with quadrature phased signals which in turn couple to orthogonal linear polarisations. It will be appreciated that the stub projection 20 is equivalent to a short circuit from junction 19 centrally located over the aperture 14 to the ground plane quadrant between slots 15 and 16 occupied by the stub. When a signal is applied to linear conductor 17 voltage in the stub projection 20 induces a voltage difference in the ground plane across the slot marked 16 thereby causing a current flow around the slot marked 16 in FIG. 6. When the feed is supplied to linear conductor 18 and not to conductor 17, a similar situation occurs except that the voltage in the stub projection 20 induces a potential difference in the ground plane across the slot marked 15. It will therefore be seen that as the two conductors 17 and 18 are energised in quadrature phase with each other the induced currents in the ground plane are orthogonal to each other thereby resulting in high quality circular polarisation of the transmitted signal.

Figure 7:
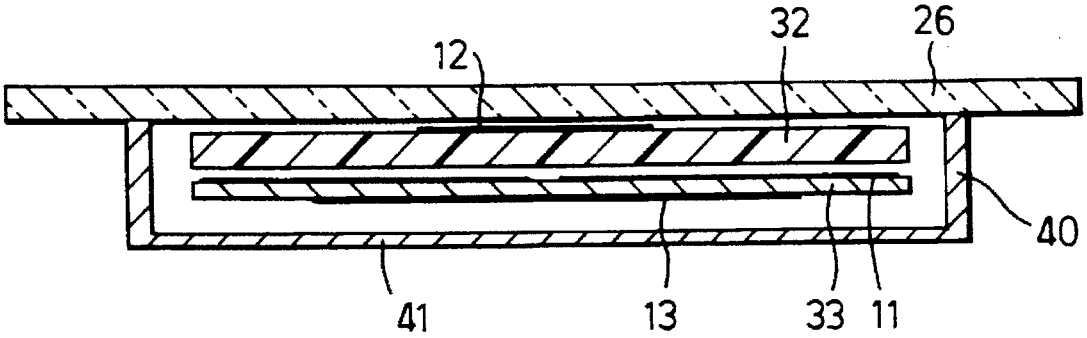
FIG. 7 is a section through a modified embodiment of the invention shown as an after market product for attachment to a vehicle glazing panel.

In the arrangement shown in FIG. 7 the laminar patch antenna is formed as an after market assembly 40 in which the patch 12, foam layer 32, ground plane 11, printed circuit board 33 with feedlines 13 are mounted in a housing 41. The assembly 40 is made as a separate unit from the vehicle windscreen and the housing 40 is arranged to abut the glass plane 26 and be secured thereto with the patch 12 closely adjacent the glass 26.

It will be appreciated that in the above embodiments the dielectric properties of the layer between the patch 12 and ground plane 11 can be carefully controlled by selection of a foam layer of desired thickness and dielectric properties so as to achieve low losses of transmission and reception together with high quality of circular polarisation. The large air content of the foam will result in a well defined dielectric constant, near 1, and can have low losses. The system may be arranged to operate at approximately 1.5 GHz which is particularly suitable for a global positioning system. The ability of the foam to accommodate small changes in shape allow the unit to accommodate small curvatures in glass without straining the printed circuit board. The foam layer can be made thicker than that of normal glass sheets used in vehicle glazing panels and in this way the antenna bandwidth can be increased making it less sensitive to tolerance variations.

Some examples of materials that may be used for the foam layer 32 are PTFE, or Neoprene, or EPDM, or nitrile or polythene.

Figure 8:
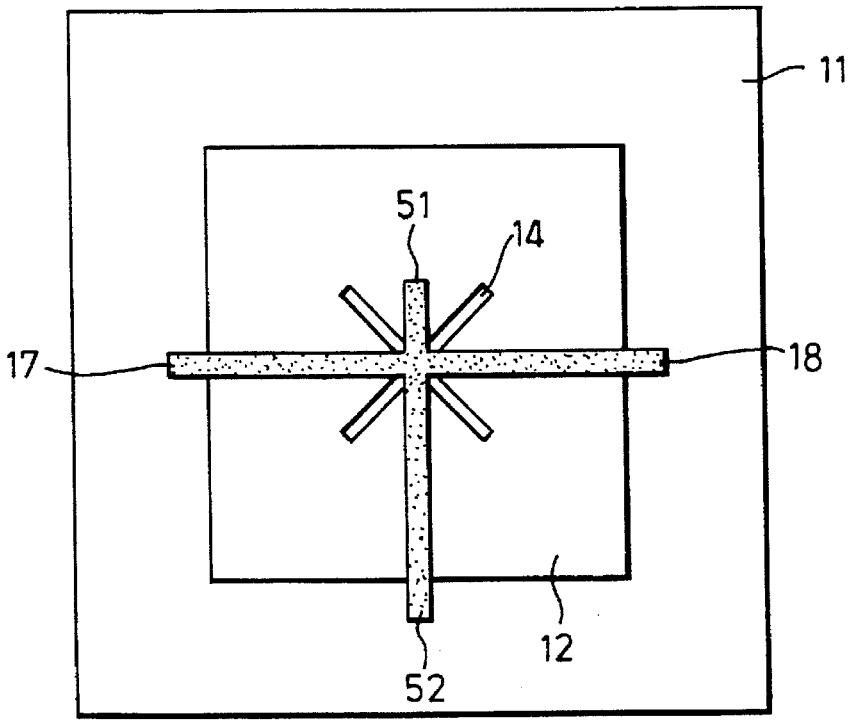
FIG. 8 is a plan view of another embodiment of the invention.

FIG. 8 shows an alternative embodiment which is generally similar to that of FIG. 3 but it includes two stub projections 51 and 52 in addition to the two feed lines 17 and 18. It will be seen that the two stub projections are mutually aligned with each other as Ere the two feed lines 17 and 18. All four linear conductors are orthogonal to each other and are arranged so that the two stub projections 51 and 52 overlie opposite sectors of the ground plane and equally the two feed lines 17 and 18 overlie opposite sectors of the ground plane. In this example the stub projection 51 is much shorter than the stub projection 52. Stub 51 provides an impedance of $-jZ$ whereas stub 52 provides an impedance of $+jZ$. The feeds 17 and 18 provide dual orthogonal circular polarisation feeds.

Figure 9:
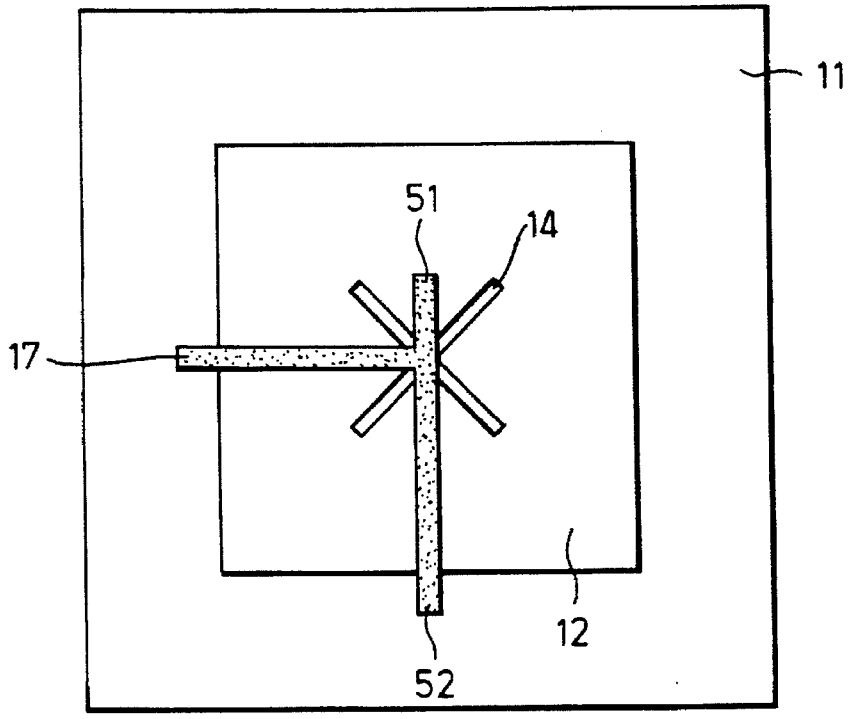
FIG. 9 is a similar view of yet another embodiment of the invention.
Figure 10:
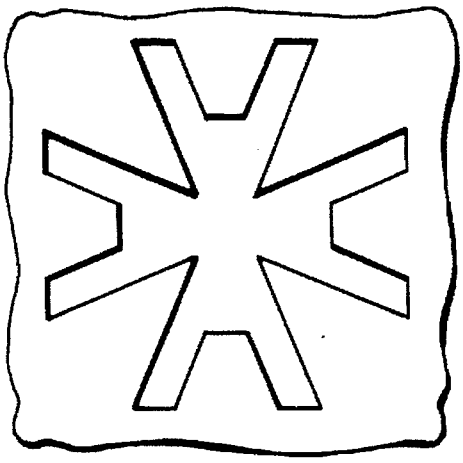
FIGS. 10–13 show different shapes of aperture which may be used in embodiments of the invention.
Figure 11:
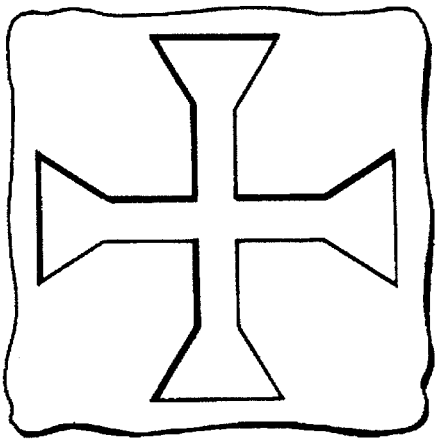
Figure 12:
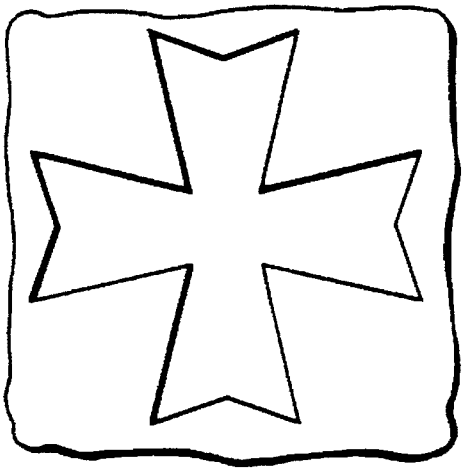
Figure 13:
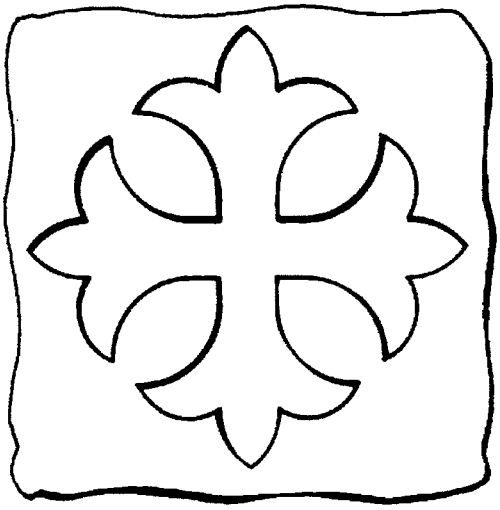

When only one hand of circular polarisation is needed it is not necessary to use the two feeds 17 and 18 of FIG. 8. An embodiment for this purpose is shown in FIG. 9 which is generally similar to that of FIG. 9 although feed line 18 has been omitted. This will then provide circular polarisation of a single hand as determined by the feed line 17.

The invention is not limited to the details of the foregoing examples. The patch antenna may be secured to a roof light on a vehicle. Although the examples in FIGS. 1 and 2 show a simple cross-shaped aperture, other cross-shapes may be used particularly having four slot arrangements each lying symmetrically at 90° intervals around a centre of the cross. Other designs meeting this requirement are shown in FIGS. 10–13. It will be seen that in each of these cases the slots arranged on each of the four perpendicular axes are symmetrical although each slot has a form of outward taper increasing the slot width on moving away from the centre of the cross. With a T-shaped feed system symmetrically located over these modified cross-shaped apertures circular polarisation is still effectively achieved where the two linear feed conductors lie symmetrically over the midpoints of two opposing sectors between apertures of the cross.

I claim:

1. A laminar patch antenna comprising a ground plane element having opposing first and second faces, a first dielectric planar member adjacent the first face of the ground plane element, a patch radiator on a face of the first dielectric member remote from the ground plane element, a second dielectric planar member adjacent the second face of the ground plane element, and a transmission line circuit for feeding the antenna, which circuit is located on a face of the second dielectric member remote from the ground plane element, said ground plane element having a cross-shaped aperture formed by two intersecting slots to couple the transmission line circuit to the patch radiator, and said transmission line circuit comprising at least three linear conductors joined end to end at a junction overlying a centre of said cross-shaped aperture with each of said linear conductors overlying a respective sector between slots of said cross-shaped aperture, each of said linear conductors being one of a first type forming a feed line and a second type forming a stub projection providing an electrical impedance between said junction and the ground plane in a sector underlying the stub projection, wherein conductors overlying oppositely located sectors are of a same type and conductors overlying sectors adjacent a common slot are of a different type.

2. A laminar patch antenna according to claim 1 in which two feed lines are provided end to end overlying opposite sectors of the ground plane.

3. A laminar patch antenna according to claim 2 in which a single stub projection is provided overlying a sector of the ground plane between said opposite sectors of the ground plane.

4. A laminar patch antenna according to claim 2 in which two stub projections are provided overlying respective sectors of the ground plane between said opposite sectors of the ground plane.

5. A laminar patch antenna according to claim 1 in which a single feed line and two stub projections are provided.

6. A laminar patch antenna according to claim 1 in which the linear conductors are arranged orthogonally relative to each other.

7. A laminar patch antenna according to claim 1, wherein at least one stub has a projection length of one-quarter wavelength of the antenna wavelength.

8. A laminar patch antenna according to claim 1 in which the cross-shaped aperture comprises two linear slots arranged at right angles to each other and the conductors are symmetrically arranged relative to the cross-shaped aperture so that each conductor of the tranmission line circuit lies midway between a pair of slots.

9. A laminar patch antenna according to claim 1 in which said patch is secured to a glass sheet forming part of a vehicle glazing panel.

10. A laminar patch antenna according to claim 1 in which said second dielectric member comprises a printed circuit board.

11. A laminar patch antenna according to claim 1 in which said first dielectric member comprises a porous compressible layer.

12. A laminar patch antenna according to claim 11 in which said first dielectric member comprises a layer of porous plastics foam.

13. A laminar patch antenna comprising a ground plane element having opposing first and second faces, a first dielectric planar member adjacent a first face of the ground plane element, a patch radiator on a face of the first dielectric member remote from the ground plane element, a second dielectric planar member adjacent the second face of the ground plane element, and a transmission line circuit for feeding the antenna, which circuit is located on a face of the second dielectric member remote from the ground plane element, said ground plane element having across-shaped aperture formed by two intersecting slots to couple the transmission line circuit to the patch radiator, said first dielectric planar member comprising a porous compressible layer, and said transmission line circuit comprising at least three linear conductors having ends joined at a mutual junction overlying a center of the cross-shaped aperture and each of said linear conductors extending from the center to overlie a sector between slots of the cross-shaped aperture, each of said linear conductors being formed as one of a feedline type and a stub projection type, the stub projection type providing an electrical impedance between said junction and the ground plane in a sector underlying the stub projection, wherein conductors disposed in oppositely located sectors are of a same type and conductors disposed in sectors adjacent a common slot are of a different type.

14. A laminar patch antenna according to claim 13 in which said first dielectric planar member comprises a layer of porous plastics foam.

15. A laminar patch antenna according to claim 13 in which said second dielectric planar member comprises a printed circuit board.

16. A laminar patch antenna according to claim 13 in which said transmission line circuit comprises two linear conductors aligned end to end and at least one stub projection at right angles to the linear conductors at their junction.

17. A laminated patch antenna assembly for attachment to an inner surface of a vehicle glazing panel, which assembly comprises:

a laminar patch antenna having a ground plane element having opposing first and second faces, a first dielectric planar member adjacent a first face of the ground plane element, a patch radiator on a face of the first dielectric member remote from the ground plane element, a second dielectric planar member adjacent the second face of the ground plane element, and a transmission line circuit for feeding the antenna, which circuit is located on a face of the second dielectric member remote from the ground plane element, said ground plane element having across-shaped aperture formed by two intersecting slots to couple the transmission line circuit to the patch radiator, said first dielectric planar member comprising a porous compressible layer, and said transmission line circuit comprising at least three linear conductors having ends joined at a mutual junction overlying a center of the cross-shaped aperture and each of said linear conductors extending from the center to overlie a sector between slots of the cross-shaped aperture, each of said linear conductors being formed as one of a feedline type and a stub projection type, the stub projection type providing an electrical impedance between said junction and the ground plane in a sector underlying the stub projection, wherein conductors disposed in oppositely located sectors are of a same type and conductors disposed in sectors adjacent a common slot are of a different type, and means for securing said compressible layer face to face against said inner surface, the compressibility of the layer being sufficient to permit the layer to conform with, and lie face to face with, a contour of said inner surface.

* * * * *